US010627179B1

(12) United States Patent
Grego et al.

(10) Patent No.: US 10,627,179 B1
(45) Date of Patent: Apr. 21, 2020

(54) M4A1 HELICALLY FLUTED BARREL

(71) Applicant: U.S. Army Combat Capabilities Development Command Armaments Center, Picatinny Arsenal, Dover, NJ (US)

(72) Inventors: Thomas C. Grego, Chester, NJ (US); Adam Foltz, Long Valley, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/357,628

(22) Filed: Mar. 19, 2019

(51) Int. Cl.
*F41A 21/24* (2006.01)

(52) U.S. Cl.
CPC ..... *F41A 21/24* (2013.01)

(58) Field of Classification Search
CPC ..... F41A 21/24; F41A 21/28
USPC ..... 89/14.1
See application file for complete search history.

(56) References Cited

U.S. PATENT DOCUMENTS 2,609,631 A * 9/1952 Garand ..... F41A 21/04 42/76.01
2,663,961 A * 12/1953 White ..... F41A 21/42 42/79
2,687,591 A * 8/1954 Lamb ..... F41A 21/22 42/76.02
2,852,835 A * 9/1958 Herbert ..... B21C 3/16 42/78
2,975,677 A * 3/1961 Kelly, Jr. ..... B21C 37/153 42/76.01
3,738,044 A * 6/1973 Robinson ..... F41A 21/00 42/75.02
3,780,465 A * 12/1973 Polcha ..... F41A 21/18 148/565
5,837,921 A * 11/1998 Rinaldi ..... F41A 13/12 89/14.1
D426,611 S * 6/2000 Behling ..... D22/100
6,324,780 B1 * 12/2001 Behling ..... F41A 21/18 42/78
6,508,159 B1 * 1/2003 Muirhead ..... F41A 21/24 42/76.01
8,025,003 B1 * 9/2011 Saur ..... F41A 21/24 42/76.01
9,261,316 B2 * 2/2016 Arnedo Vera .... B29C 45/14065
9,261,319 B1 * 2/2016 Palu ..... F41A 21/34
9,446,440 B2 * 9/2016 Engesser ..... B21C 37/152
D790,647 S * 6/2017 Miller, III ..... D22/108
9,677,838 B2 * 6/2017 Faxon ..... F41A 21/24
2007/0193102 A1 * 8/2007 Briggs ..... F41A 21/02 42/76.02
2007/0261286 A1 * 11/2007 Briggs ..... F41A 21/02 42/76.02
2008/0276795 A1 * 11/2008 Trigo ..... F41A 21/12 89/14.1
2010/0307045 A1 * 12/2010 Taylor ..... F41A 21/18 42/76.1

* cited by examiner

*Primary Examiner* — Michelle Clement
(74) *Attorney, Agent, or Firm* — Michael C. Sachs

(57) ABSTRACT

An M4A1 helically fluted gun barrel is provided which increases sustained peak temperature levels for the barrel. This M4A1 helically fluted gun barrel incorporates multi-start variable pitch helical openings into the exterior profile of a standard M4A1 heavy barrel. The helical openings increase the outer surface area for heat dissipation, and also reduce weight as a further advantage.

3 Claims, 4 Drawing Sheets

M4A1 HELICALLY FLUTED BARREL

U.S. GOVERNMENT INTEREST

The inventions described herein may be made, used, or licensed by or for the U.S. Government for U.S. Government purposes.

FIELD AND BRIEF SUMMARY OF THE INVENTION

It is an aim of this invention to improve the standard M4A1 heavy rifle gun barrel to withstand greater heat during firing action without degrading performance. These improvements include improved heat dissipation, improved cook-off resistance, increased sustained rate of firing, improved dispersion performance, and reduced bore erosion resulting in increased barrel life. It is a further important benefit of the invention to lessen the weight of the improved gun barrel relative to current weight of an M4A1 gun barrel.

The helically fluted heavy rifle gun barrel for the M4 carbine rifle of this invention incorporates multi-start variable pitch helical openings into the profile of the barrel. These helical openings increase the outer surface area of the barrel for heat dissipation. By removing material from the barrel outer profile, the openings also effect a reduction in the weight of the gun barrel. Advantages of the multi-start variable pitch helical openings are not only that the barrel surface area is increased and barrel weight is reduced, but also that target dispersion and reliability of the weapon system remain unchanged.

BACKGROUND OF THE INVENTION

The M4A1 is a 5.56 mm lightweight carbine that is air-cooled, gas-operated, and magazine-fed. The M4A1 has a semiautomatic or full automatic fire capability and provides personnel with an offensive/defensive capability to engage targets with direct small arms fire. The M4A1 currently implements a gun barrel which is heavier and of larger outer diameter than the M4 standard barrel. The M4A1 heavy barrel was designed and implemented to increase heat dispersion in order to reduce cook off and barrel failure in the M4 carbine due to high temperatures exhibited during high cadence firing. The M4A1 heavy barrel carbine has become an Army standard carbine. The M4A1 helically fluted barrel of this invention was developed to increase heat dispersion and to reduce weight without negatively affecting the reliability and balistic effects of the overall M4A1 system. All rifles and carbines are detrimentally affected by heat. By reducing the heat input into the system or by increasing the rate at which heat can be disipated, the life expectancy and reliability of the rifle/carbine can be improved. The weight that a warfighter must typically carry is also burdensome on his/her ability to operate, thus a rifle/carbine's weight must ideally be reduced to an optimal level that will not affect the operation of the weapon itself. There are several methods by which heat dispersion might be achieved. These include increasing the mass of the heat absorbing material, increasing the surface area of the heat disipating material, cooling of the material through liquids or gasses flowing over the surface of the material, using different materials with more conductive thermal properties, or by reducing the temperature of the gases within the system. Each of these methods have their benefits and detriments with most resulting in the increased weight of the system.

The M4A1 helically fluted barrel of this invention by contrast incorporates multi-start variable pitch helical openings incorporated into the profile of the M4A1 heavy barrel. The helical openings remove material from the barrel outer profile, reducing weight, and also increase the outer surface area for heat dissipation. The advantage of incorporating the multi-start variable pitch helical openings is not only that the weight is reduced and the surface area is increased, but also that the target dispersion and reliability of the system remain unchanged. There is no 'drooping' of the barrel (destructive bending) with intense heat, for example. Several prototype M4A1 helically fluted barrels of this invention have been successfully tested with improvements fully demonstrated with regard to, e.g., lower weight, deflection, target accuracy, and heat dispersion characteristics. Further, barrel weight reductions of approximately 0.25 pounds have been successfully accomplished due to these helical openings. Temperatures as high as 909.5 degrees Fahrenheit peak temperature were sustained for the barrel, thus even exceeding current operating amounts.

OBJECTS OF THE INVENTION

Accordingly, it is an object of the present invention to provide a heavy gun barrel for the M4 carbine rifle which will exhibit increased sustained peak temperature levels.

Another object of the present invention is to provide a heavy gun barrel for the M4 carbine which will further reduce weight of the gun barrel.

It is a further object of the present invention to provide a helically fluted gun barrel for the M4 carbine rifle which incorporates multi-start variable pitch helical openings into the exterior profile of the standard M4A1 heavy barrel.

It is a still further object of the present invention to provide a heavy gun barrel for the M4 carbine rifle which will exhibit increased heat dissipation properties thereof while the target dispersion and reliability of the system remains unchanged.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

Figure 5:
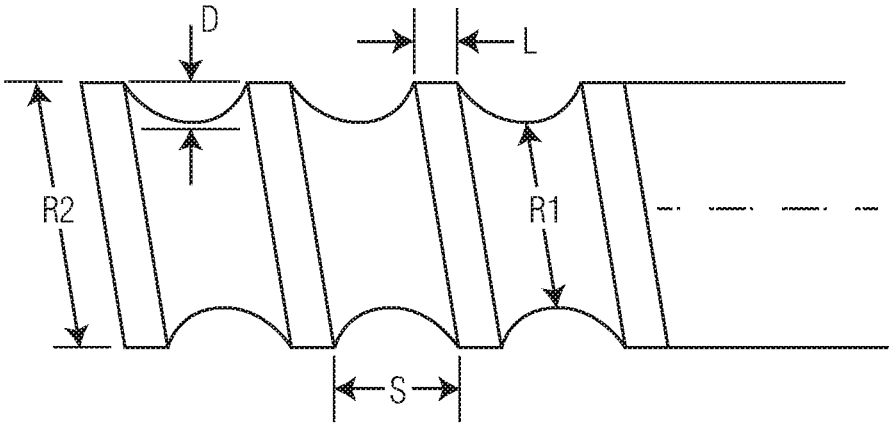
Figure 6:
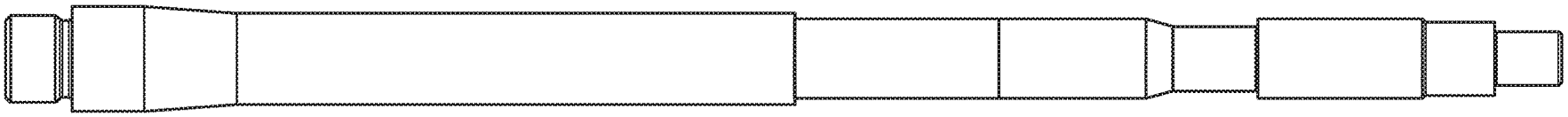

FIG. 5 provides a sketch to explain depth, spacing, and width, e.g., of openings which may be provided in the barrel exterior, and;

FIG. 6 shows outside view of one standard M4A1 rifle, heavy gun barrel.

DETAILED DESCRIPTION

Figure 1:
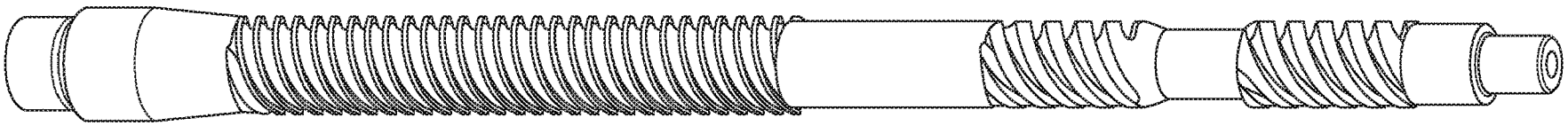
FIG. 1 is a right side looking isometric view (from the muzzle end) of an M4A1 Helically Fluted Gun Barrel according to this invention.
Figure 2:
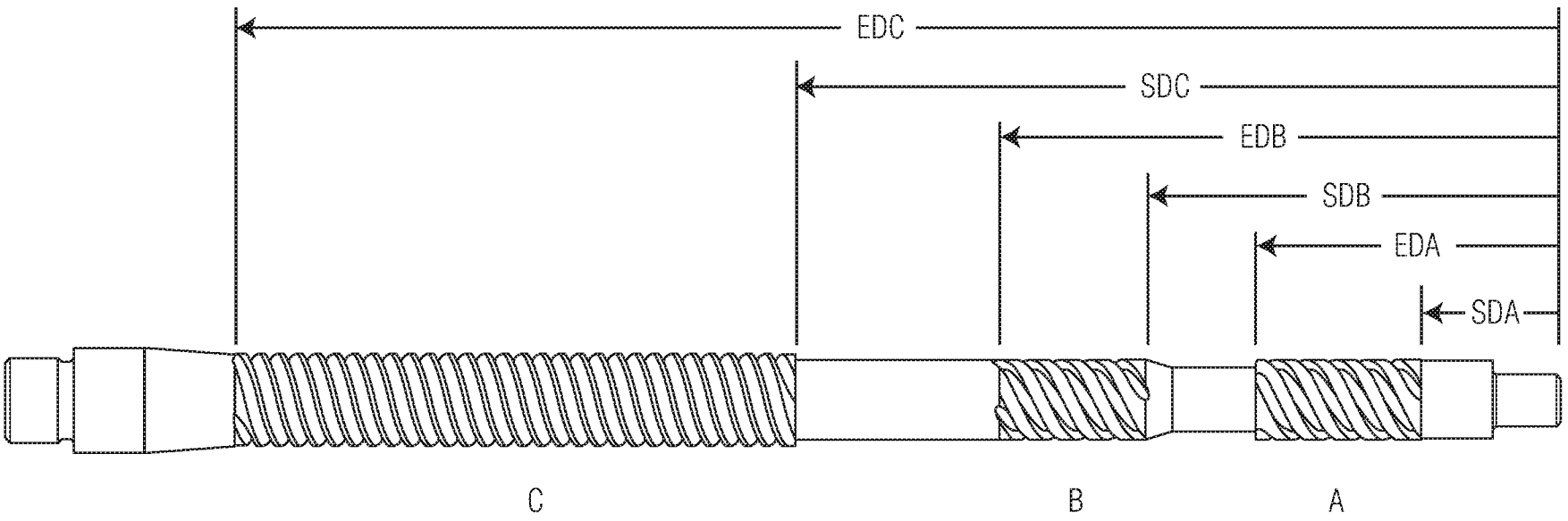
FIG. 2 is a front elevation view of an M4A1 Helically Fluted Gun Barrel in accordance with this invention, showing start and end dimensions of three sections of the barrel (A, B, and C) where openings may be present in accordance with this invention.

FIG. 1 shows a right side looking isometric view (from the muzzle end) of an M4A1 Helically Fluted Gun Barrel according to this invention. It has three different sections (A, B, and C) in which there are openings in accordance with this invention; the location of these three sections are given in FIG. 2. The openings shown there may be formed of 4-start screw threads.

The first set of openings (Section A) begin at a start distance SDA from the muzzle end and continue through until an end distance EDA from the muzzle end, being flat top helically fluted identical openings, advance in clockwise fashion, at identical pitch PA, and have fin spacing SA therein between, have fin length LA, and have fin depth DA on all the openings thereof, and have identical cross sectional shapes on all the openings within said first set of openings.

The second set of openings (Section B) begin at a start distance SDB from the muzzle end and continue through until an end distance EDB from the muzzle end, being flat top helically fluted identical openings, advance in clockwise fashion, at identical pitch PB, and have fin spacing SB therein between, have fin length LB, and have fin depth DB on all the openings thereof, and have identical cross sectional shapes on all the openings within said second set of openings.

The third set of openings (Section C) begin at a start distance SDC from the muzzle end and continue through until an end distance EDC from the muzzle end, being flat top helically fluted identical openings, advance in clockwise fashion, at identical pitch PC, and have fin spacing SC therein between, have fin length LC, and have fin depth DC. The fin depth gradually tapers down on the openings thereof all the way along until the end of Section C. The openings in Section C all have analogously similar cross sectional shapes within the said third set of openings.

The fin thickness and spacing between adjacent turns of the helix are selected for efficient removing of heat; some of the considerations include the following. A thicker fin increases the stiffness of the barrel for strength. More spacing allows better escape of heat but more turns per inch can dissipate much more heat than fewer. Too many turns per inch makes a sharp surface that may be hard to grip for barrel removal and replacement. Depth of the openings cannot be made too great lest the remaining wall thickness of the barrel in places becomes too thin for the barrel to hold the pressures within it during firing. This invention of a multi-start helically fluted barrel may also be used on weapons other than the M4A1. The benefits could include higher cook-off limit, increased sustained rate of fire, increased stiffness which reduces barrel deflection yielding better accuracy, reduced erosion, and reduced weight.

The following describes one successful embodiment of the invention.

The first set of openings (Section A) begin at a start distance SDA=1.27 inches from the muzzle end and continue through until an end distance EDA=2.85 inches from the muzzle end, being flat top helically fluted identical openings, advance in clockwise fashion, at identical pitch PA=1.2, and have fin spacing SA=0.14 inches therein between, and have fin length LA=0.15 inches, and have fin depth DA=0.15 inches on all the openings thereof, and have identical cross sectional shapes on all the openings within said first set of openings.

The second set of openings (Section B) begin at a start distance SDB=3.87 inches from the muzzle end and continue through until an end distance EDB=5.24 inches from the muzzle end, being flat top helically fluted identical openings, advance in clockwise fashion, at identical pitch PB=1.2, and have fin spacing SB=0.13 inches therein between, and have fin length LB=0.15 inches, and have fin depth DB=0.15 inches on all the openings thereof, and have identical cross sectional shapes on all the openings within said second set of openings.

The third set of openings (Section C) begin at a start distance SDC=7.15 inches from the muzzle end and continue through until an end distance EDC=12.37 inches from the muzzle end, being flat top helically fluted identical openings, advance in clockwise fashion, at identical pitch PC=0/4, and have fin spacing SC=0.14 inches therein between, and have fin length LC=0.045 inches, and have fin depth DC. The fin depth DC starts at being=0.15 inches, and gradually tapers all along Section C until it reaches down to 0.05 inches on the openings thereof at the end of Section C. The openings in Section C all have analogously similar cross sectional shapes within the said third set of openings.

While the openings in sections A, B, and C were described as being 4-start threading, they might also be multi-start, i.e., in multiples other than four. The pitch P of these threads may also be made variable, either within a given set of openings or variable as between different sets of openings. It is noted that the openings extend substantially along the length of the barrel, and may cover more than half of the exterior surface of the barrel. It will be appreciated that the openings result in: reduced barrel weight; improved heat dissipation; improved cook-off resistance; increased sustained rate of firing; optimized dispersion performance, and reduced bore erosion which results in increased barrel life.

Figure 3:
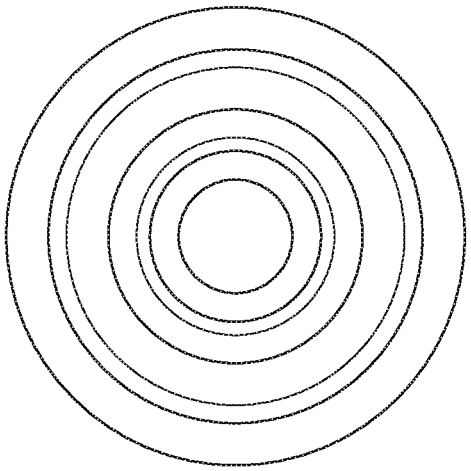
FIG. 3 is a right side elevation view (muzzle end) of an M4A1 Helically Fluted Gun Barrel M4A1 according to this invention.
Figure 4:
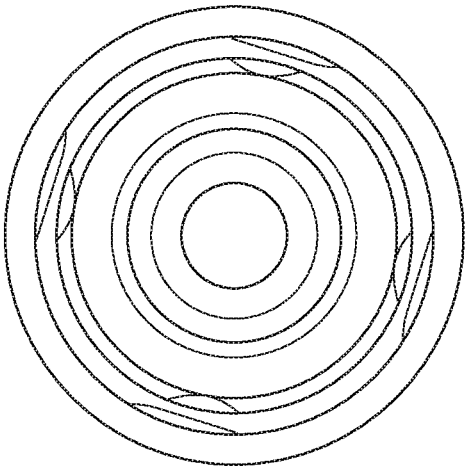
FIG. 4 is a left side elevation view (breech end) of an M4A1 Helically Fluted Gun Barrel according to this invention.

FIG. 3 shows a right side elevation view (muzzle end) of an M4A1 Helically Fluted Gun Barrel M4A1 according to this invention, and FIG. 4 shows a left side view (breech end) thereof. FIG. 5 provides a sketch to illustrate depth D, spacing S, width L, small radius R1, large radius R2, of the openings provided in the barrel exterior according to this invention. FIG. 6 shows the exterior of a standard M4A1 rifle, heavy gun barrel (no openings). Several prototype M4A1 helically fluted barrels of this invention have been successfully tested with improvements fully demonstrated with regard to, e.g., lower weight, deflection, target accuracy, and heat dispersion characteristics. Further, barrel weight reductions of approximately 0.25 lbs. have been successfully accomplished, due to these helical openings. Temperatures as high as 909.5 degrees Fahrenheit peak temperatures were sustained for the barrel, even exceeding current operating amounts.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An improvement to a M4A1 weapon's Heavy Barrel wherein said Heavy Barrel's exterior surface (FIG. 6) then has certain specific openings (FIG. 2) made thereon for enhancing the Heavy Barrel's heat dissipation capacity, being:

helically fluted openings on the exterior surface of the said Heavy Barrel, and, with all distances as measured from the muzzle end of the said Heavy Barrel, said helically fluted openings comprising:

a first set of openings (Section A) beginning at a start distance SDA=1.27 inches from the muzzle end and continuing through until an end distance EDA=2.85 inches from the muzzle end, being flat top helically fluted identical openings, advancing in clockwise fashion, at identical pitch P=1.2, and having fin spacing S=0.14 inches therein between, and having fin length L=0.15 inches, and having fin depth D=0.15 inches on all the openings thereof, and having identical cross sectional shapes on all the openings within said first set of openings, and;

a second set of openings (Section B) beginning at a start distance SDB=3.87 inches from the muzzle end and continuing through until an end distance EDB=5.24 inches from the muzzle end, being flat top helically fluted identical openings, advancing in clockwise fashion, at identical pitch P=1.2, and having fin spacing S=0.13 inches therein between, and having fin length L=0.15 inches, and having fin depth D=0.15 inches on all the openings thereof, and having identical cross sectional shapes on all the openings within said second set of openings, and;

a third set of openings (Section C) beginning at a start distance SDC=7.15 inches from the muzzle end and continuing through until an end distance EDC=12.37 inches from the muzzle end, being flat top helically fluted identical openings, advancing in clockwise fashion, at identical pitch P=0.74, and having fin spacing S=0.14 inches therein between, and having fin length L=0.045 inches, and having fin depth D=0.15 inches, tapering down to 0.05 inches on the openings thereof, and having identical cross sectional shapes on all the openings within said third set of openings.

2. The improvement to the M4A1 weapon's Heavy Barrel of claim 1, wherein the openings (FIG. 2) are grooves.

3. The improvement to the M4A1 weapon's Heavy Barrel of claim 1, wherein the openings (FIG. 2) are cut as threads.

* * * * *